US011821062B2

(12) United States Patent
Wolf et al.

(10) Patent No.: US 11,821,062 B2
(45) Date of Patent: Nov. 21, 2023

(54) CEMENTED CARBIDE COMPOSITIONS AND APPLICATIONS THEREOF

(71) Applicant: Kennametal Inc., Latrobe, PA (US)

(72) Inventors: Manfred Wolf, Eckersdorf (DE); Armin Helldoerfer, Wiesenttal (DE)

(73) Assignee: KENNAMETAL INC., Latrobe, PA (US)

( * ) Notice: Subject to any disclaimer, the term of this patent is extended or adjusted under 35 U.S.C. 154(b) by 0 days.

(21) Appl. No.: 16/859,254

(22) Filed: Apr. 27, 2020

(65) Prior Publication Data

US 2020/0340084 A1 Oct. 29, 2020

(30) Foreign Application Priority Data

Apr. 29, 2019 (DE) ..... 102019110950.7

(51) Int. Cl.
*C22C 29/08* (2006.01)
*C22C 29/06* (2006.01)

(52) U.S. Cl.
CPC ..... *C22C 29/08* (2013.01); *C22C 29/067* (2013.01)

(58) Field of Classification Search
None
See application file for complete search history.

(56) References Cited

U.S. PATENT DOCUMENTS 1,893,078 A * 1/1933 Genuit ..... C22C 29/08 75/240
2,635,579 A 4/1953 Chadsey, Jr. et al.
2,765,227 A 10/1956 Goetzel et al.
2,840,458 A 6/1958 Hamister
3,113,889 A 12/1963 Cooper et al.
3,181,968 A 5/1965 Mandorf, Jr. et al.
3,322,513 A 5/1967 Corbett
3,345,448 A 10/1967 Malkin
3,451,791 A 6/1969 Meadows et al.
3,480,410 A 11/1969 Hummer et al.
3,572,672 A 3/1971 Harel et al.
(Continued)

FOREIGN PATENT DOCUMENTS

CN 1194115 C 3/2005
CN 1958836 A 5/2007
(Continued)

OTHER PUBLICATIONS

Oct. 14, 2005 Opposition by Sandvik AB Against DE Application No. 10135790, 36 Pages.
(Continued)

*Primary Examiner* — Humera N. Sheikh
*Assistant Examiner* — Kim S. Horger
(74) *Attorney, Agent, or Firm* — Larry R. Meenan

(57) ABSTRACT

Sintered cemented carbides are described herein exhibiting enhanced high temperature properties without dramatic losses in bending strength. In some embodiments, a sintered cemented carbide composition comprises tungsten carbide, a metallic binder phase comprising at least one metal of the iron group, and at least one solid solution carbide phase comprising tantalum (Ta) and molybdenum (Mo), wherein a value of (Mo/Ta) in the sintered cemented carbide composition is from 0.3-100, and the sintered cemented carbide composition has a transverse rupture strength of at least 4000 MPa.

15 Claims, 3 Drawing Sheets

(56) References Cited

U.S. PATENT DOCUMENTS

| | | | | |
|---|---|---|---|---|
| 3,673,006 | A | 6/1972 | Plumat et al. | |
| 3,676,006 | A | 7/1972 | Velzel et al. | |
| 3,677,722 | A | 7/1972 | Rymas | |
| 3,724,996 | A | 4/1973 | Montgomery | |
| 3,981,062 | A | 9/1976 | Moskowitz et al. | |
| 3,999,954 | A | 12/1976 | Kolaska et al. | |
| 4,264,803 | A | 4/1981 | Shinko | |
| 4,446,357 | A | 5/1984 | Barshter | |
| 4,526,840 | A | 7/1985 | Jerabek | |
| 4,880,960 | A | 11/1989 | Remondiere et al. | |
| 5,009,705 | A | 4/1991 | Yoshimura et al. | |
| 5,032,366 | A | 7/1991 | Finicle | |
| 5,182,149 | A | 1/1993 | Finicle | |
| 5,182,567 | A | 1/1993 | Wilder | |
| 5,239,612 | A | 8/1993 | Morris | |
| 5,253,266 | A | 10/1993 | Knodle, III et al. | |
| 5,305,840 | A | 4/1994 | Liang et al. | |
| 5,421,852 | A | 6/1995 | Maruyama et al. | |
| 5,604,164 | A | 2/1997 | Montgomery et al. | |
| 5,671,322 | A | 9/1997 | Finicle | |
| 5,902,942 | A | 5/1999 | Maderud et al. | |
| 5,904,781 | A | 5/1999 | Goodman et al. | |
| 5,918,102 | A | 6/1999 | Friederichs | |
| 5,951,769 | A | 9/1999 | Barnard et al. | |
| 6,027,808 | A | 2/2000 | Aoki et al. | |
| 6,081,652 | A | 6/2000 | Seifert | |
| 6,085,025 | A | 7/2000 | Seifert | |
| 6,207,262 | B1 | 3/2001 | Ichikawa et al. | |
| 6,228,139 | B1 | 5/2001 | Oskarsson | |
| 6,254,658 | B1 | 7/2001 | Taniuchi et al. | |
| 6,514,456 | B1 | 2/2003 | Lackner et al. | |
| 6,645,572 | B2 | 11/2003 | Seifert | |
| 7,179,319 | B2 * | 2/2007 | Heinrich | C22C 1/053 428/545 |
| 7,494,616 | B2 | 2/2009 | Rusinko, Jr. et al. | |
| 9,005,329 | B2 | 4/2015 | Norgren et al. | |
| 2002/0112564 | A1 | 8/2002 | Eidel et al. | |
| 2005/0072269 | A1 | 4/2005 | Banerjee | |
| 2006/0051618 | A1 | 3/2006 | Festeau et al. | |
| 2006/0062900 | A1 | 3/2006 | Selvamanickam | |
| 2006/0131081 | A1 | 6/2006 | Mirchandani et al. | |
| 2006/0171837 | A1 * | 8/2006 | Heinrich | C22C 29/08 419/15 |
| 2007/0003718 | A1 | 1/2007 | Nakashima et al. | |
| 2007/0251732 | A1 | 11/2007 | Mirchandani et al. | |
| 2008/0196318 | A1 | 8/2008 | Bost et al. | |
| 2008/0226943 | A1 | 9/2008 | Fang et al. | |
| 2008/0264342 | A1 | 10/2008 | Saito et al. | |
| 2009/0217876 | A1 | 9/2009 | Epstein | |
| 2009/0293672 | A1 | 12/2009 | Mirchandani et al. | |
| 2011/0052931 | A1 | 3/2011 | Morton et al. | |
| 2011/0223552 | A1 | 9/2011 | Kobayashi | |
| 2011/0286877 | A1 | 11/2011 | Gries | |
| 2012/0009728 | A1 | 1/2012 | Li | |
| 2012/0210822 | A1 * | 8/2012 | Konyashin | C22C 1/051 75/236 |
| 2013/0105231 | A1 | 5/2013 | Oakes et al. | |
| 2013/0112288 | A1 | 5/2013 | Liu et al. | |
| 2014/0298728 | A1 | 10/2014 | Keshavan | |
| 2016/0208373 | A1 | 7/2016 | Lattimer | |
| 2016/0208374 | A1 | 7/2016 | Lattimer | |
| 2017/0217839 | A1 * | 8/2017 | Chen | C22C 1/1036 |
| 2018/0274065 | A1 | 9/2018 | Konyashin et al. | |
| 2018/0305790 | A1 * | 10/2018 | Liu | E21B 10/567 |

FOREIGN PATENT DOCUMENTS

| | | | |
|---|---|---|---|
| CN | 101294271 | A | 10/2008 |
| CN | 102191473 | A | 9/2011 |
| CN | 106702250 | A | 5/2017 |
| CN | 108165860 | A | 6/2018 |
| CN | 109402479 | A * | 3/2019 |
| CN | 109439993 | A | 3/2019 |
| DE | 267063 | A1 | 4/1989 |
| DE | 4000223 | C2 | 7/1993 |
| DE | 10393947 | T5 | 2/2006 |
| DE | 102006001855 | A1 | 7/2007 |
| DE | 102007035166 | A1 | 1/2009 |
| DE | 102007045289 | A1 | 4/2009 |
| DE | 10393947 | B4 | 12/2012 |
| DE | 102015122552 | A1 | 7/2016 |
| EP | 0214679 | A1 | 3/1987 |
| EP | 1054071 | A2 | 11/2000 |
| EP | 2267185 | A1 | 12/2010 |
| FR | 743472 | A | 3/1933 |
| GB | 715704 | A | 9/1954 |
| GB | 1085041 | A | 9/1967 |
| GB | 1309634 | A | 3/1973 |
| JP | S6383236 | A | 4/1988 |
| JP | S6452043 | A | 2/1989 |
| JP | H0324922 | A | 2/1991 |
| JP | H06212341 | A | 8/1994 |
| JP | H07300666 | A | 11/1995 |
| JP | H09111391 | A | 4/1997 |
| JP | H1121651 | A | 1/1999 |
| JP | 2012076156 | A | 4/2012 |
| TW | 201203561 | A | 1/2012 |
| WO | 0052217 | A1 | 9/2000 |
| WO | 2006080888 | A1 | 8/2006 |
| WO | 2006117119 | A1 | 11/2006 |
| WO | 2008025447 | A1 | 3/2008 |
| WO | 2014122306 | A2 | 8/2014 |
| WO | WO2015092528 | A1 | 6/2015 |

OTHER PUBLICATIONS

Jan. 13, 2016 Opposition EP App. No. 1409757.
Jan. 13, 2017 Non-Final Office Action for U.S. Appl. No. 14/600,437, 21 Pages.
Jan. 23, 2017 Office action (3 months) U.S. Appl. No. 14/600,471, 27 pages.
Mar. 24, 2017 Office action (3 months) 1 U.S. Appl. No. 10/336,654.
Jul. 13, 2017 Final Office Action U.S. Appl. No. 14/600,471, 31 pages.
Aug. 24, 2017 Final Office Action U.S. Appl. No. 14/600,437, 27 Pages.
Oct. 5, 2017 Advisory Action (PTOL-303) 1.
Oct. 25, 2017 Final Office Action U.S. Appl. No. 10/336,654.
Nov. 3, 2017 Advisory Action (PTOL-303) 1.
Dec. 29, 2017 Non-Final Office Action U.S. Appl. No. 14/600,471, 27 Pages.
Jan. 22, 2018 Advisory Action (PTOL-303) 1 U.S. Appl. No. 10/336,654.
Apr. 12, 2018 Final Office Action U.S. Appl. No. 14/600,471, 35 pages.
May 30, 2018 Office Action (non-US).
May 31, 2018 Office action (3 months) (US Only) U.S. Appl. No. 10/336,654.
Jun. 22, 2018 Advisory Action (PTOL-303) 1.
Sep. 11, 2018 Notice of Allowance U.S. Appl. No. 14/600,471, 13 Pages.
Sep. 25, 2018 Office Action (non-US) DE App. No. 102016115784A1.
Nov. 2, 2018 Final Office Action (US Only) U.S. Appl. No. 10/336,654.
Nov. 2, 2018 Office Action (non-US) CN App. No. 105803401.
NOv. 2, 2018 Office Action (non-US) CN App. No. 105803402.
Feb. 21, 2019 Notice of Allowance U.S. Appl. No. 10/336,654.
Jun. 21, 2019 Office Action (non-US) CN App. No. 105803401.
Jun. 21, 2019 Office Action (non-US) CN App. No. 105803402.
Dec. 12, 2019 Non-Final Office Action U.S. Appl. No. 14/600,437, 18 Pages.
Dec. 20, 2019 Notice of Allowance CN App. No. 105803402.
Dec. 23, 2019 Notice of Allowance CN App. No. 105803401.
Mar. 7, 2022 Office Action (non-US) DE No. 10 2015122552.2.
May 7, 2022 Office Action (non-US) CN App. No. 111850368A.
May 9, 2022 Office Action (non-US) DE App. No. 102015122692.
Dec. 9, 2022 Foreign Office Action Chinese Application No. CN202010198953.9, 21 pages.

(56) References Cited

OTHER PUBLICATIONS

ASTM International, Designation: B611-13, "Standard Test Method for Determining the High Stress Abrasion Resistance of Hard Materials," 2013, 6 pages.
ASTM International, Designation: B771-11'1, "Standard Test Method for Short Rod Fracture Toughness of Cemented Carbides," 2012, 8 pages.
Brookes K.J.A., "World Directory and Handbook of Hardmetals and Hard Materials," International Carbide Data, Jan. 1, 1992, p. 23, XP055255218.
Carroll D.F., "Processing and Properties of Ultrafine WC/Co Hard Metals," The Dow Chemical Company, Proceedings of 14th International Plansee Seminar, AG Reutte, HM14, 1997, vol. 2, pp. 168-182.
Cook B.A., et al., "Estimation of Surface Energy and Bonding Between AlMgB14 and TiB2," Journal of Physics and Chemistry of Solids, 2010, vol. 71, pp. 824-826.
Davis D.G., "The Hexagonal Close Packed Phase Stability in the Cobalt-Molybdenum System: Further Confirmation of the Brewer-Engel Theory," Lawrence Berkeley National Laboratory, Aug. 1, 1981, 38 Pages.
Davis J.R., "Tool Materials," ASM Specialty Handbook, ASM International, Materials Park, OH, 1995, p. 49.
Egami A., et al., "Morphology of Vanadium Carbide in Submicron Hardmetals," Proceedings of the 13th International Plansee Seminar, 1993, vol. 03, pp. 639-648.
Egami A., et al., "Ultra Submicron Hardmetals for Miniature Drills," 12th International Plansee Seminar '89, Reutte, Tirol, Austria, Wear Resistant Materials, Proceedings, May 8-12, 1989, vol. 02, pp. 53-70, XP008129762.
"Evaporator Boats," Kennametal Sintec, 2017, 8 pages.
Exner H.E., "Physical and Chemical Nature of Cemented Carbides," International Metals Reviews, Jan. 1, 1979, No. 4, pp. 149-173, XP055255211.
Gille G., et al., "A New 0.4 UM WC Powder as Well as Powder-Related Properties and Sintering Behaviour of 0.6 to 30 μm WC-Co Hardmetals," Proceedings of the 14th International Plansee Seminar AG Reutte, HM12, 1997, vol. 2, pp. 139-167.
Guilemany J.M., et al., "Mechanical-Property Relationships of Co/WC and Co—Ni—Fe/WC Hard Metal Alloys," In International Journal of Refractory Metals and Hard Materials, Derwent Abstracts: JP11021651A, 1993-1994, vol. 12, pp. 199-206.
Hitachi Tool Eng Ltd: Patent Abstracts of Japan JP Application No. JP09111391A, Apr. 28, 1997 (Aug. 28, 1997), vol. 1997, No. 08.
Holleck H., "Binary and Ternary Carbide and Nitride Systems of the Transition Metals," Material Science Technical Series, Jan. 1, 1984, vol. 06, pp. 126-127 and 134-135, XP055255206.
International Search Report for International Application No. PCT/IB2002/002384, dated Dec. 17, 2002, 3 Pages.
Nachi Fujikoshi Corp: Patent Abstracts of Japan Database Accession No. (C-604), JP Application No. JP01052043A, Feb. 28, 1989 (Jun. 6, 1989), vol. 013, No. 241.
Prakash L.J., "Properties of Submicron wc Based Cemented Carbides," Metal Powder Report, Dec. 1, 1989, vol. 44, No. 12, pp. 835-838, XP055255182.
Rathod N., "The Effect of Surface Properties of Boron Nitride on Polymer Processability," The University of British Columbia, Jun. 2003, 93 pages.
Roebuck B., et al., "Measurement Good Practice Guide No. 20," Mechanical Tests for Hardmetals, 1999, pp. 1-31, XP055255184.
Shuzhu, Zhou, Production Principle and Quality Control of Cemented Carbide, Metallurgical Industry Press, p. 233, Aug. 31, 2014.
Smalc M., et al., "Thermal Performance of Natural Graphite Heat Spreaders," Interpack 2005-73073, Proceedings of IPACK2005, ASME Interpack '05, San Francisco, CA, July 17-22, pp. 1-11.
Upadhyaya G.S., "Cemented Tungsten Carbides—Production, Properties, and Testing," Indian Institute of Technology, 1998, pp. 122-123, XP055255215.
Xue, Jia-Xiang et al., Pressure-induced Preferential Grain Growth, Texture Development and Anisotropic Properties of Hot Pressed Hexagonal Boron Nitride Ceramics, SciVerse ScienceDirect, Scripta Materialia 65 (2011), pp. 966-969.
Zackrisson J., et al., "WC-Co Based Cemented Carbides with Large Cr3C2 Additions," International Journal of Refractory Metals Hard Materials, 1998, vol. 16, pp. 417-422, XP005026095.
Zhou Shuzhu, "Production Principle and Quality Control of Cemented Carbide," Metallurgical Industry Press, Aug. 31, 2014, p. 233.
Feb. 14, 2023 Foreign Office Action German Application No. DE201510122552, 16 Pages.

* cited by examiner

CEMENTED CARBIDE COMPOSITIONS AND APPLICATIONS THEREOF

RELATED APPLICATION DATA

The present application claims priority pursuant to 35 U.S.C. § 119(a) to German Patent Application Number 102019110950.7 filed Apr. 29, 2019 which is incorporated herein by reference in its entirety.

FIELD

The present invention relates to sintered cemented carbide compositions and, in particular, to sintered cemented carbide compositions exhibiting enhanced bending strength and enhanced high-temperature properties.

BACKGROUND

In cemented carbides for metal cutting purposes, the quality of a cemented carbide is often determined by its high temperature properties. Hardness of cemented carbides can be reduced dramatically with increasing temperatures with simultaneous increases in scaling and degradative diffusion processes. Additionally, deformation properties of sintered cemented carbides can change substantially at high temperatures. A basic WC—Co cemented carbide, for example, will feature only about one third of its hardness at 800° C. compared to hardness at room temperature. Additions of TiC and (Ta,Nb)C to the WC—Co cemented carbide can increase hot hardness, but losses in hardness may still exceed fifty percent.

Mechanical properties of cemented carbides are also affected by high temperatures encountered during carbide sintering conditions. Grain growth, for example, is very difficult avoid during sintering and hot isostatic pressing (HIPping) of green compacts. As is well known, excessive grain growth can negatively impact bending strength of the sintered cemented carbide. Therefore, specific metal carbides are added to the green compact as grain growth inhibitors.

The complexity of process sequences in cemented carbide manufacture is still further increased in that both tungsten from the tungsten carbide and metals of the grain growth inhibitors diffuse into the binder phase to form a solid solution. Since the solubility of these metals in the binder increases with temperature, the maximum dissolved concentration at a particular temperature can be exceeded, whereby excessive amounts precipitate out of the binder phase or deposit on the surface of the WC grains. Such deposition, however, impairs wetting of the grains with the binder metal, which in turn results in deterioration of the bending strength. With these current technologies, a careful balance is required between desirable high temperature properties and desirable bending strength.

SUMMARY

In view of the foregoing disadvantages, sintered cemented carbides are described herein exhibiting enhanced high temperature properties without dramatic losses in bending strength. In some embodiments, a sintered cemented carbide composition comprises tungsten carbide, a metallic binder phase comprising at least one metal of the iron group, and at least one solid solution carbide phase comprising tantalum (Ta) and molybdenum (Mo), wherein a value of (Mo/Ta) in the sintered cemented carbide composition is from 0.3-100, and the sintered cemented carbide composition has a transverse rupture strength of at least 4000 MPa.

In another aspect, a sintered cemented carbide composition comprises tungsten carbide, a metallic binder phase comprising at least one metal of the iron group, and at least one solid solution carbide phase comprising tantalum, molybdenum, and vanadium, wherein tantalum is present in an amount exceeding the solubility limit of tantalum in the metallic binder phase.

In preferred embodiments, vanadium is present in an amount less than tantalum,

In some embodiments, the sintered cemented carbide composition further comprises chromium. In preferred embodiments, the solid solution carbide phase further comprises chromium. Preferably chromium is present in an amount less than tantalum.

In further preferred embodiments, molybdenum is present in an amount of 0.5-3 wt. % of the sintered cemented carbide composition, preferably 0.5 to 2.5 wt. %.

These and other embodiments are further described in the following detailed description.

DETAILED DESCRIPTION

Figure 1:
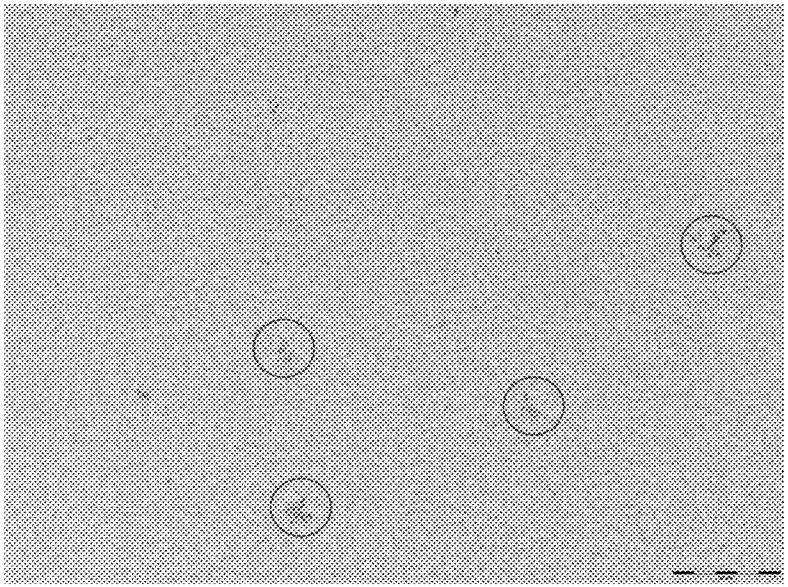
FIGS. 1-3 are optical micrographs illustrating precipitated solid solution clusters of a sintered cemented carbide according to some embodiments.

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

In one aspect, a sintered cemented carbide composition comprises tungsten carbide, a metallic binder phase comprising at least one metal of the iron group, and at least one solid solution carbide phase comprising tantalum (Ta) and molybdenum (Mo), wherein a value of (Mo/Ta) in the sintered cemented carbide composition is from 0.3-100, and the sintered cemented carbide composition has a transverse rupture strength of at least 4000 MPa.

Turning now to specific components, sintered cemented carbide compositions described herein comprise tungsten carbide (WC). Tungsten carbide of the sintered composition can exhibit any average grain size consistent with the objectives of the present invention. In some embodiments, for example, tungsten carbide grains have an average size of 0.1 μm to 5 μm. Tungsten carbide grains can also have an average size selected from Table I.

TABLE I

| WC Average Grain Size (μm) |
|---|
| 0.3-3 |
| 0.5-2 |
| 0.1-1.5 |
| 0.5-1.3 |

Grain size can be determined according to the linear intercept measure. As detailed further herein, tungsten carbide constitutes the balance of the sintered cemented carbide compositions.

Sintered cemented carbide compositions also comprise a metallic binder phase comprising at least one metal of the iron group. In some embodiments, the metallic binder phase is cobalt-based alloy or solely cobalt. The metallic binder phase can be present in any desired amount. The metallic binder phase can generally be present in an amount of 1 weight percent to 30 weight percent of the sintered cemented carbide composition. Metallic binder phase may also be present in the sintered cemented carbide in an amount selected from Table II.

TABLE II

| Metallic Binder Phase (wt. %) |
|---|
| 1-20 |
| 5-20 |
| 3-15 |
| 8-12 |

In addition to tungsten carbide and the metallic binder phase, the sintered cemented carbide comprises at least one solid solution carbide phase comprising tantalum (Ta) and molybdenum (Mo), wherein a value of (Mo/Ta) in the sintered cemented carbide is from 0.3-100. In some embodiments, the value of (Mo/Ta) is from 1 to 10 or from 1 to 5. Additional (Mo/Ta) values for the sintered cemented carbide composition can be selected from Table III.

TABLE III

| (Mo/Ta) Value in Sintered Cemented Carbide |
|---|
| 0.3-5 |
| 0.3-3 |
| 1-3 |
| 0.5-20 |

In relation to the Mo/Ta value, Mo can generally be present in the sintered cemented carbide composition in an amount of 0.5 to 5 weight percent. In some embodiments, Mo is present in the sintered cemented carbide in an amount selected from Table IV.

TABLE IV

| Mo wt. % in Sintered Cemented Carbide |
|---|
| 0.5-3 |
| 0.7-2 |
| 0.8-1.5 |
| 3.5-5 |

Similarly, in relation to the Mo/Ta value, Ta can generally be present in the sintered cemented carbide in an amount of 0.05 to 1.5 weight percent. In some embodiments, Ta is present in amount exceeding the solubility limit of Ta in the metallic binder phase. Weight percent of Ta in the sintered cemented carbide can also be selected from Table V.

TABLE V

| Ta wt. % in Sintered Cemented Carbide |
|---|
| 0.1-1.1 |
| 0.2-0.7 |

TABLE V-continued

| Ta wt. % in Sintered Cemented Carbide |
|---|
| 0.25-0.5 |
| 0.25-0.35 |

In some embodiments, the solid solution carbide phase can comprise elements in addition to Ta and Mo. The solid solution phase, for example, can further comprise W to provide a (Ta,Mo,W)C solid solution phase.

Moreover, sintered cemented carbide compositions described herein can exhibit high hardness and desirable bending strengths. Applicant has made the discovery that adding molybdenum to the sintered cemented carbide composition can mitigate losses to bending strength induced by increases in tantalum, such as TaC or (Ta,Nb)C, for limiting grain growth and improving hot hardness. Accordingly, sintered cemented carbide compositions described herein can exhibit fine grain structure and high hardness without concomitant losses in bending strength. The sintered cemented carbide compositions exhibit a transverse rupture strength (TRS) of at least 4000 MPa or at least 4500 MPa. In some embodiments, a sintered cemented carbide composition has a transverse rupture strength of 4300 to 4800 MPa. Sintered cemented carbide compositions described herein may also have a transverse rupture strength greater than 4800 MPa. Transverse rupture strength for sintered cemented carbides is determined according to International Organization for Standardization (ISO) 3327:2009. In addition to the foregoing TRS values, sintered cemented carbide compositions described herein exhibit high hardness. A sintered cemented carbide composition, for example, can have hardness of at least 1500 HV30. In some embodiments, a sintered cemented carbide composition has hardness of 1600-2000 HV30. Hardness values are determined according to ASTM E384-17, Standard Test Method for Microindentation Hardness for Materials.

Sintered cemented carbide compositions described here may further comprise chromium. Chromium can generally be present in the sintered cemented carbide composition in an amount of 0.05 to 0.5 weight percent. While increasing hardness, chromium in excess of 0.5 weight percent can result in substantial reductions in transverse rupture strength. In some embodiments, for example, chromium is present in the sintered cemented carbide in an amount less than the tantalum. Alternatively, chromium can be present in the sintered cemented carbide in an amount greater than the tantalum. Additionally, chromium can be incorporated into the solid solution carbide phase comprising Ta and Mo.

Sintered cemented carbide compositions described herein may further comprise vanadium. Vanadium, for example, can be present along with Ta and Mo. In other embodiments, vanadium is present with Ta, Mo, and Cr. Vanadium can generally be present in the sintered cemented carbide composition in an amount of 0.05 weight percent to 0.15 weight percent. For example, vanadium can be present in the sintered cemented carbide composition in an amount of 0.05 to 0.10 wt. % or 0.10 to 0.15 wt. %. In some embodiments, vanadium is present in an amount less than tantalum (V/Ta<1). When present, vanadium may be incorporated into the solid solution phase, such as (V,Ta,Mo)C or (V,Ta, Mo,Cr)C. Tungsten, in some embodiments, can be incorporated into any of the solid solution carbide phases described herein.

Figure 2:
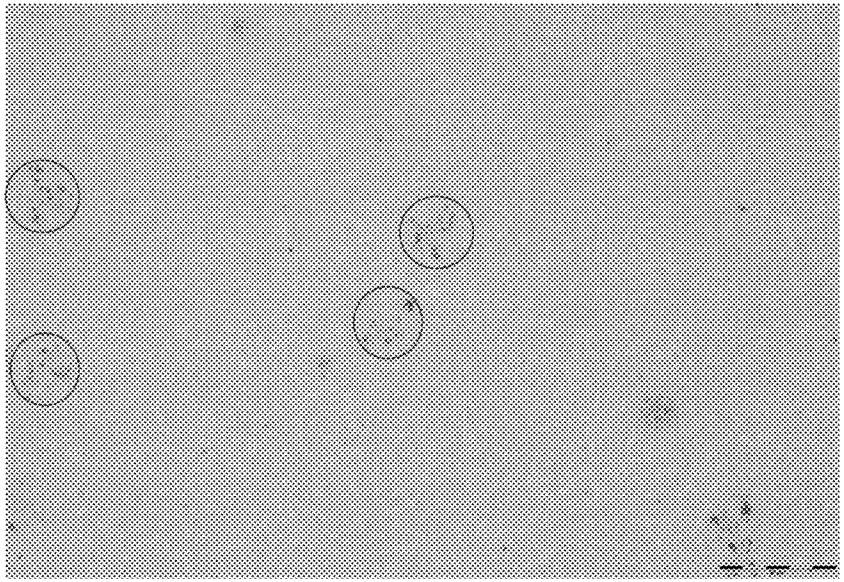

The solid solution carbide phase comprising Ta and Mo and, optionally, one or more of V, Cr and W, can precipitate as clusters in the sintered cemented carbide, in some embodiments. Clusters of the solid solution carbide phase can exhibit regular and/or irregular geometries. FIG. 1 is an optical micrograph illustrating precipitated solid solution carbide clusters (circled) of a sintered carbide comprising 0.3 wt. % Ta, 0.96 wt. % Mo, 0.24 wt. % Cr. The sintered cemented carbide of FIG. 1 exhibited TRS of 4501 MPa and hardness of 1560 HV30. Contrary to conventional practice, precipitation of the solid solution carbide phase as one or more clusters can enhance bending strength of the sintered cemented carbide as evidenced by the TRS data, in some embodiments. Similar effects are demonstrated by sintered cemented carbide compositions described herein comprising Ta, Mo, Cr and V. FIG. 2 is an optical micrograph illustrating precipitated solid solution carbide clusters in a sintered cemented carbide comprising 0.3 wt. % Ta, 1.5 wt. % Mo, 0.10 wt. % Cr, and 0.12 wt. % V. The sintered cemented carbide of FIG. 2 exhibited a TRS of 4549 MPa and hardness of 1650 HV30.

Precipitated solid solution carbide clusters can be randomly distributed throughout the sintered cemented carbide. Additionally, precipitated solid solution clusters can display differing sizes. Generally, solid solution carbide clusters have at least one dimension of 5 μm or more. In some embodiments, diameter of a precipitated solid solution cluster is at least 5 μm. A solid solution carbide cluster may have more than one dimension measuring at least 5 μm.

In another aspect, a sintered cemented carbide composition comprises tungsten carbide, a metallic binder phase comprising at least one metal of the iron group, and at least one solid solution carbide phase comprising tantalum, molybdenum, and vanadium, wherein tantalum is present in an amount exceeding the solubility limit of tantalum in the metallic binder phase. In some embodiments, vanadium is present in the sintered cemented carbide composition in an amount less than the tantalum, (V/Ta)<1. Additionally, the solid solution carbide phase may further comprise chromium and/or tungsten, in some embodiments. In some embodiments, chromium is present in an amount greater than vanadium. Tungsten carbide and the metallic binder phase of the sintered composition can have any properties described herein, including those provided in Tables I and II above. Similarly, molybdenum and vanadium can be present in the sintered cemented carbide composition in amounts selected from Table IV and V above. In some embodiments, chromium is optionally present in an amount of 0.05 to 0.5 weight percent.

As described herein, the solid solution carbide phase comprising tantalum, molybdenum, and vanadium can precipitate as one or more clusters. The solid solution clusters can have any of the properties and dimensions described above. Moreover, sintered cemented carbide compositions comprising at least one solid solution carbide phase including tantalum, molybdenum, and vanadium can exhibit any TRS and/or hardness values described above. In some embodiments, for example, the sintered cemented carbide has TRS of at least 4000 MPa or at least 4500 MPa and hardness of at least 1500 HV30.

Sintered cemented carbide compositions described herein, in some embodiments, exhibit magnetic saturation of 75-85% or 75-80%. Magnetic saturation values recited herein are based on magnetic component(s) of the metallic binder phase and are determined according to ASTM B 886-12, "Standard Test Method for Determination of Magnetic Saturation (MS) of Cemented Carbides," ASTM International. As known to one of skill in the art, magnetic saturation values may be converted from percentages to $\mu Tm^3/kg$ or other comparable units based on comparison to a nominally pure Co binder phase. For example, see Roebuck, B. Magnetic Moment (Saturation) Measurements on Hardmetals, *Int. J. Refractory Metals & Hard Materials,* 14 (1996) 419-424. Additionally, sintered cemented carbide compositions described herein can be free of eta phase and/or other lower carbides, such as $W_2C$.

Sintered cemented carbide compositions described herein can be prepared by providing powdery starting materials including WC as the main constituent, metallic binder, and compounds of Ta and Mo as well as, optionally, compounds of Cr and/or V and milling the starting materials in a ball mill or attrition mill with the addition of carbon or tungsten and/or sintering aids to provide a grade powder. Compounds of Ta, Mo, Cr and/or V can include carbides and/or oxides of these elements. In some embodiments, one or more of Ta, Mo, Cr and V can be added as metal powder. The grade powder is formed into a green article, and the green article is vacuumed sintered or sintered-hot isostatic press (HIP) at a temperature ranging from 1350° C. to 1560° C. for a time period sufficient to produce the sintered cemented carbide of desired density and microstructure.

Sintered cemented carbides described herein can be employed in various applications including, but not limited to, cutting tools. In some embodiments, sintered cemented carbide compositions are formed into cutting inserts, such as indexable turning inserts and interrupted cutting inserts. The sintered cemented carbide compositions can also be formed into rotary cutting tools including drills and endmills of various geometries. In some embodiments, sintered cemented carbide articles having composition and properties described herein are coated with one or more refractory materials by PVD and/or CVD. In some embodiments, the refractory coating comprises one or more metallic elements selected from aluminum and metallic elements of Groups IVB, VB and VIB of the Periodic Table and one or more non-metallic elements selected from Groups IIIA, IVA, VA and VIA of the Periodic Table. For example, the refractory coating can comprise one or more carbides, nitrides, carbonitrides, oxides or borides of one or more metallic elements selected from aluminum and Groups IVB, VB and VIB of the Periodic Table. Additionally, the coating can be single-layer or multi-layer.

These and other embodiments are further illustrated by the following non-limiting examples.

Example 1—Sintered Cemented Carbide Articles

Sintered cemented carbide articles having the compositions set forth in Table VI were produced as follows. Grade powder having the desired compositional parameters of each sample in Table VI was compacted into a green article having shape and dimensions required by ISO 3327:2009. The green article was pressure sintered at peak temperature of 1400° C. to provide the sintered cemented carbide article for TRS and hardness testing. Ta, Mo, V and Cr were employed in grade powders of the relevant samples as TaC, $Mo_2C$, VC, and $Cr_3C_2$ respectively. Comparative samples were also prepared where Mo was absent from the composition.

TABLE VI

| Sintered Cemented Carbide Articles | | | | | | | | |
|---|---|---|---|---|---|---|---|---|
| Sample | WC | Co (wt. %) | Ta (wt. %) | Mo (wt. %) | Cr (wt. %) | V (wt. %) | HV30 | TRS |
| 1* | Bal. | 10 | 0.30 | — | 0.24 | — | 1565 | 4197 |
| 2 | Bal. | 10 | 0.30 | 0.96 | 0.24 | — | 1560 | 4501 |
| 3 | Bal. | 10 | 0.30 | 1.50 | 0.24 | — | 1595 | 4680 |
| 4 | Bal. | 10 | 0.30 | 3.00 | 0.24 | — | 1660 | 4532 |
| 5* | Bal. | 10 | 0.60 | — | 0.24 | — | 1575 | 4036 |
| 6 | Bal. | 10 | 0.60 | 0.96 | 0.24 | — | 1598 | 4280 |
| 7 | Bal. | 10 | 0.60 | 1.50 | 0.24 | — | 1614 | 4110 |
| 8* | Bal. | 10 | 1.10 | — | 0.24 | — | 1573 | 3994 |
| 9 | Bal. | 10 | 1.10 | 0.96 | 0.24 | — | 1594 | 4161 |
| 10 | Bal. | 10 | 1.10 | 1.50 | 0.24 | — | 1616 | 4264 |
| 11 | Bal. | 10 | 0.30 | 1.50 | — | 0.06 | 1597 | 4489 |
| 12 | Bal. | 10 | 0.30 | 1.50 | — | 0.12 | 1652 | 4549 |
| 13 | Bal. | 10 | 0.30 | 1.50 | 0.10 | 0.06 | 1621 | 4611 |

*Comparative Sample

From the results of Samples 2-4 relative to comparative Sample 1, it is clearly seen that the addition of molybdenum increases hardness and TRS for a constant Ta content. Additionally, Samples 6-7 and 10-11 demonstrate that Mo can offset reductions to bending strength (TRS) conventionally induced by increased Ta content. Accordingly, higher amounts of Ta can be used to inhibit grain growth and increase hardness without degrading bending strength.

Figure 3:
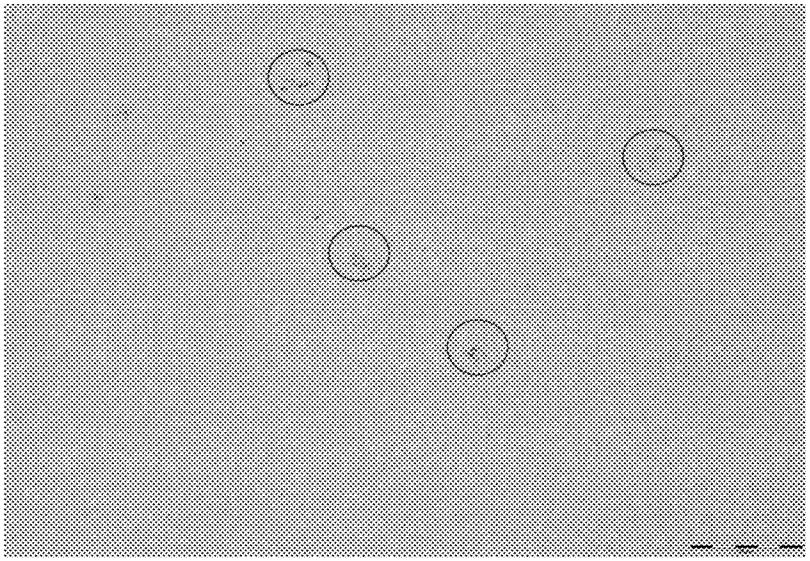

Samples 11-13 illustrate synergistic effects of adding small quantities of vanadium to the sintered cemented carbide compositions. In particular, the addition of vanadium in conjunction with small amounts of Cr provide the sintered cemented carbide composition with excellent hardness and TRS. Moreover, increased amounts of vanadium can drive precipitation of larger solid solution clusters. FIG. 3 is an optical micrograph of Sample 11, wherein the vanadium content is 0.06 wt. %. Solid solution cluster precipitates are circled. FIG. 2 is an optical micrograph of Sample 12, wherein the vanadium content is 0.12 wt. % yielding solid solution cluster precipitates of larger size. Even with the larger dimension of the precipitates, desirable TRS values were achieved. The larger size precipitates can induce higher hardness and TRS values.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A sintered cemented carbide composition comprising: tungsten carbide, a metallic binder phase comprising at least one metal of the iron group, and at least one solid solution carbide phase comprising tantalum (Ta) and molybdenum (Mo), wherein a value of (Mo/Ta) in the sintered cemented carbide composition is from 0.3-100 and the sintered cemented carbide composition has a transverse rupture strength of at least 4000 MPa, wherein the metallic binder phase is present in an amount of 1-20 wt. %, Ta is present in an amount of 0.05-1.5 wt. %, Mo is present in an amount of 0.5 to 5 wt. % with the tungsten carbide being a main constituent and providing a balance of the sintered cemented carbide composition, and wherein the sintered cemented carbide composition optionally includes chromium in an amount of 0.05 to 0.5 wt. % and/or vanadium in an amount of 0.05-0.15 wt. %, and further wherein, an amount of chromium in the sintered cemented carbide composition does not exceed 0.5 wt. %.

2. The sintered cemented carbide composition of claim 1, wherein Ta is present in an amount exceeding the solubility limit of Ta in the metallic binder phase.

3. The sintered cemented carbide composition of claim 2, wherein the value of (Mo/Ta) is from 1 to 10.

4. The sintered cemented carbide composition of claim 2, wherein the value of (Mo/Ta) is from 1 to 5.

5. The sintered cemented carbide composition of claim 1, having hardness of at least 1500 HV30.

6. The sintered cemented carbide composition of claim 1, having hardness of 1600-2000 HV30.

7. The sintered cemented carbide composition of claim 5, wherein the transverse rupture strength is at least 4300 MPa.

8. The sintered cemented carbide composition of claim 1, wherein the chromium is present in the composition in an amount of 0.05 to 0.5 wt. %.

9. The sintered cemented carbide composition of claim 8, wherein the chromium is part of the solid solution carbide phase.

10. The sintered cemented carbide composition of claim 8, wherein the chromium is present in an amount less than the tantalum.

11. The sintered cemented carbide composition of claim 1, wherein the vanadium is present in the composition in an amount of 0.05-0.15 wt. %.

12. The sintered cemented carbide composition of claim 11, wherein the vanadium is present in an amount less than the tantalum.

13. The sintered cemented carbide composition of claim 11, wherein the vanadium is part of the solid solution carbide phase.

14. The sintered cemented carbide composition of claim 1 having a magnetic saturation of 75-85%.

15. The sintered cemented carbide composition of claim 14, wherein the solid solution carbide phase precipitates as clusters.

* * * * *